US005563027A

United States Patent [19]

Johnston et al.

[11] Patent Number: 5,563,027

[45] Date of Patent: Oct. 8, 1996

[54] COLOR REVERSAL ELECTRONIC OUTPUT FILM

[75] Inventors: Cheryl S. Johnston, Fairport; John D. Baloga, Rochester, both of N.Y.

[73] Assignee: Eastman Kodak Company, Rochester, N.Y.

[21] Appl. No.: 373,815

[22] Filed: Jan. 17, 1995

Related U.S. Application Data

[63] Continuation-in-part of Ser. No. 338,929, Nov. 14, 1994, abandoned.

[51] Int. Cl.[6] ..... G03C 1/005

[52] U.S. Cl. ..... 430/509; 430/502; 430/503; 430/596; 430/407; 430/378; 430/379

[58] Field of Search ..... 430/502, 503, 430/509, 596, 372, 376, 378, 379, 407

[56] References Cited

U.S. PATENT DOCUMENTS

| | | | |
|---|---|---|---|
| 3,849,138 | 9/1974 | Wyckoff | 96/74 |
| 4,161,406 | 7/1979 | Bulloch | 96/55 |
| 4,165,236 | 8/1979 | Aotsuka | 430/506 |
| 4,329,411 | 5/1982 | Land | 430/30 |
| 4,792,518 | 12/1988 | Kuwashima et al. | 430/505 |
| 4,804,616 | 2/1989 | Ueda et al. | 430/379 |
| 5,024,928 | 6/1991 | Loiacona et al. | 430/504 |
| 5,079,132 | 1/1992 | Mitsui et al. | 430/359 |
| 5,213,942 | 5/1993 | Deguchi et al. | 430/218 |
| 5,300,413 | 4/1994 | Sutton et al. | 430/503 |
| 5,314,794 | 5/1994 | Sutton | 430/376 |
| 5,391,443 | 2/1995 | Simons et al. | 430/503 |
| 5,420,003 | 5/1995 | Gasper et al. | 430/503 |

FOREIGN PATENT DOCUMENTS 0108250 1/1987 European Pat. Off. .

*Primary Examiner*—Geraldine Letscher
*Attorney, Agent, or Firm*—Gordon M. Stewart

[57] ABSTRACT

A color reversal element having a red sensitive layer containing a cyan dye forming coupler, a green sensitive layer containing a magenta dye forming coupler, and a blue sensitive layer containing a yellow dye forming coupler, the red, green and blue sensitive layers each having a speed $\geqq 120$ as measured at a density of 0.3, a Dmax of $\geqq 3.30$ and a $\Delta \log E \leqq 1.85$ measured from a density of 0.20 to 3.20, the Dmax and $\Delta \log E$ being measured following exposure and processing of the element. Daylight and tungsten balanced versions of the film are also provided. A method for processing such films and exposing them in electronic film writers is also provided. Film of the present invention allows a wide range of density values in an original film to be more faithfully reproduced and enable more faithful reproduction of colors recorded in the original scanned film.

18 Claims, 1 Drawing Sheet

COLOR REVERSAL ELECTRONIC OUTPUT FILM

Cross-Reference to Related Applications

Figure 1:
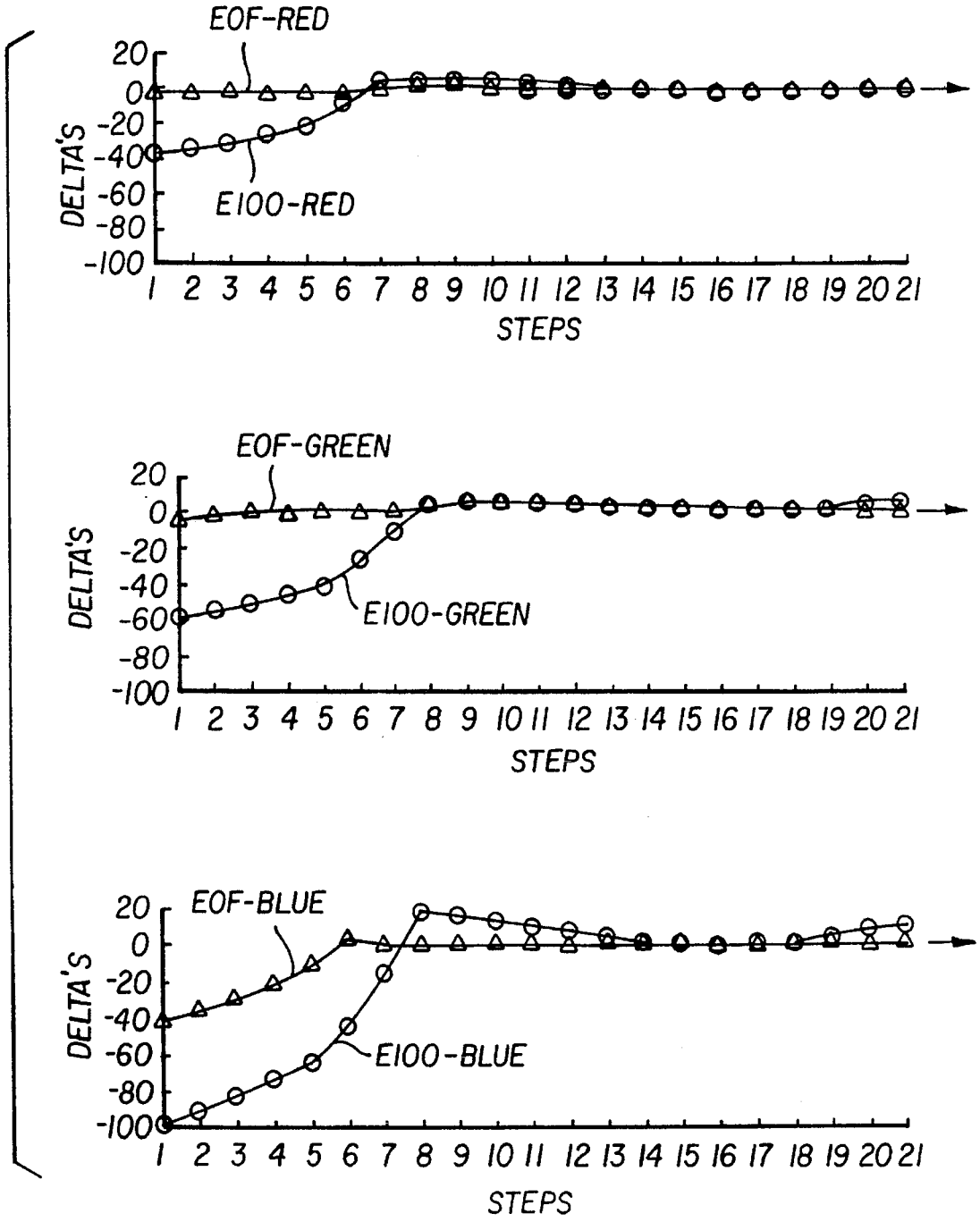

This is a continuation-in-part of application Ser. No. 08/338,929 filed Nov. 14, 1994, abandoned Entitled: COLOR REVERSAL ELECTRONIC OUTPUT FILM by: Cheryl S. Johnston et al.

FIELD OF THE INVENTION

This invention relates to color reversal photographic elements particularly useful as an output film for electronic film writers, and methods of exposing and processing such elements. The film enables more faithful color reproductions of original films.

BACKGROUND OF THE INVENTION

For many commercial applications images on an original color reversal films are electronically scanned, digitally stored in memory or recording media, and electronically modified if needed. The scanned and modified stored image is then re-written onto an output color reversal film (the "output film") by a film writer output device. In another application, output from computer generated images are written onto slides (included in the reference to "output film" in this application) for graphics presentations. The output device for these applications uses a precisely controlled light source for red, green, and blue exposure to record the image onto the output film. Typically the film writer light source is a cathode ray tube ("CRT"), although some film writers use arc lamps the output of which is controlled through light valves and a variety of other light sources and control methods are used in the trade. Examples of commercially available film writers include the FIRE 1000 film writer manufactured by Cymbolic Sciences Int., Richmond, British Columbia, Canada (for daylight balanced films), and the SATURN UR film writer manufactured by LVT Co., Rochester, N.Y., USA.

Currently, output devices record images onto existing color reversal films that were designed and optimized as normal camera picture taking films. Such films fall into two general classes, namely daylight exposure balanced film and tungsten balanced film. Thus, many film writers are designed to optimally write on one or both of those two classes. Although daylight and tungsten balanced films record the main attributes of the output image when exposed to the daylight balanced or tungsten balanced output, respectively, of a film writer, they fail to accommodate certain characteristics of the film writer output devices. In particular, the primary film writer limitation is its inability to accurately output light exposure over a broad enough intensity range to expose existing films from low density to high density. This is particularly true when higher exposures are used to produce lower film densities on the exposed and processed film. This exposure limitation can lead to "clipping" artifacts in the output image produced by film writers, such that very dark colors, very light colors, or both, which are present in the stored image, are not properly exposed and therefore not properly reproduced on the reversal film element.

Additionally, the limited characteristics of the film writer's output can lead to a failure to accurately reproduce densities on the output film such that they closely correspond with the densities on the original film. In a color system where the output film will have red, green and blue sensitive layers this is particularly critical. In particular, when an output film is used to receive the output of an electronic film writer, the density on each image portion on the processed output film should correspond as closely as possible with the density of the same image portion in the original. This requires that the density of each of the red, green and blue light for each image portion on the output film, should be as close as possible to those in the original. A greater deviation in even just one of these densities (red, green or blue light) anywhere throughout the range of densities that might be encountered in the original, can result in an increased failure of the output film to faithfully reproduce the colors of the original film.

Techniques for modifying what is known as the characteristic curve of a photographic element (or the D versus logE curve) are known. U.S. Pat. No. 3,849,138 describes a film designed with a larger latitude. U.S. Pat. No. 4,792,518 also describes varying the characteristic curve by controlling silver emulsions.

It would be desirable then to have a color reversal film which can be used with existing electronic film writers to more faithfully reproduce a broader range of image densities in the original film despite the limited range of light intensities which some existing electronic film writers can generate.

SUMMARY OF THE INVENTION

The present invention recognizes the deficiencies of many existing electronic film writers. Particularly, that they are incapable of reaching both lower and higher exposures to achieve higher and lower image densities, respectively, on the exposed and processed conventional reversal film elements without using techniques which require longer exposure times or reduce image quality. For example, higher exposures can be obtained by multiple passes of the writer light output over the film element, which is time consuming. Alternatively, for writers using a cathode ray tube ("CRT") for light output exposure of the CRT can be increased but this is done by multiple exposure passes over the output film which results in reduced productivity and can produce poorer quality images. As to lower exposures, the present invention recognizes that existing film writers often do not achieve a sufficiently low light output due to limitations in light valve efficiency and the like, so that conventional reversal elements cannot achieve a high maximum density in the writer.

The present invention therefore provides a color reversal element having a red sensitive layer containing a cyan dye forming coupler, a green sensitive layer containing a magenta dye forming coupler, and a blue sensitive layer containing a yellow dye forming coupler, the red, green and blue sensitive layers each having a speed $\geqq 120$ as measured at a density of 0.3, a Dmax $\geqq 3.30$, and a $\Delta\log E \leqq 1.85$ measured from a density of 0.20 to 3.20, the Dmax and $\Delta\log E$ being measured following exposure of the daylight or Tungsten balanced film by a simulated daylight or Tungsten light source (as appropriate) and processing of the element.

The present invention further provides a method of exposing such an element in an electronic film writer, as well as a method of processing such an element.

The present invention allows a wide range of density values in an original film to be more faithfully reproduced in a reversal film element exposed with existing film writers, without the need to modify their output in such a manner as to reduce image quality. Such a color film can additionally allow a more faithful reproduction of colors recorded in the original scanned film. Additionally, film of the present invention allows improved shadow and highlight features in the exposed and processed color reversal output film.

DRAWINGS

The Figure represents a plot of the deviation between red, green and blue densities of both prior art and inventive output films and an original film, from the densities recorded on an original film (see Example 5).

EMBODIMENTS OF THE INVENTION

In the present application, reference to "under", "above", "below", "upper", "lower" or the like terms in relation to layer structure of a photographic element, is meant the relative position in relation to light when the element is exposed in a normal manner. "Above" or "upper" would mean closer to the light source when the element is exposed normally, while "below" or "lower" would mean further from the light source. Since a typical photographic element has the various layers coated on a support, "above" or "upper" would mean further from the support, while "below" or "under" would mean closer to the support.

All values of Dmax (maximum achievable density), ΔlogE and other density values are, of course, measured following processing of the element using the standard Process E-6. All densities throughout this application, unless indicated to the contrary, are Status A integral densities. Methods used to obtain Status A densities are described, for example in James, editor, *The Theory of the Photographic Process*, 4th Edition, Macmillan, N.Y., 1977, Chapter 18. Values for "Dmax" thus represent the maximum value of density that can possibly be obtained from the invention film under any circumstances. Achievable maximum density on a particular instrument may be lower due to instrument limitations. Similarly, achievable minimum density with a particular film on a particular writer may exceed the absolute minimum density that a film is capable of achieving under any circumstances (known as "Dmin"). All speeds throughout this application, unless indicated to the contrary, are determined from the equation:

$$\text{Speed}=100\times(1-\log E)$$

where logE is determined from the film's characteristic curve and is expressed in units of lux-seconds. The light source used for daylight balanced film exposures conforms to American National Standard for Simulated Daylight ANSI PH2.29-1967 (R1976). The light source for tungsten balanced film exposures conforms to American National Standard for Simulated Incandescent Tungsten Source ANSI PH2.35-1969 (R1976). The foregoing references, and all other references cited herein, are incorporated herein by reference.

Film characteristic curves and methods for obtaining them, are well known, and are described in detail in James, *The Theory of the Photographic Process*, cited above (see particularly Chapters 17 and 18). All of the foregoing parameters, as well as other parameters discussed herein unless indicated to the contrary, assume the element is processed after exposure using the well known standard Process E6 for color reversal elements. The standard Process E6 is described in the British Journal of Photography Annual 1988, 191 and particularly pages 194–196. Such process includes processing the element for 6 minutes in each of the black and white and color developer.

Silver halide color reversal films are typically associated with an indication for processing by a color reversal process. Reference to a film being associated with an indication for processing by a color reversal process, most typically means the film, its container, or packaging (which includes printed inserts provided with the film), will have an indication on it that the film should be processed by a color reversal process. The indication may, for example, be simply a printed statement stating that the film is a "reversal film" or that it should be processed by a color reversal process, or simply a reference to a known color reversal process such as "Process E-6". A "color reversal" process in this context is one employing treatment with a non-chromogenic developer (that is, a developer which will not imagewise produce color by reaction with other compounds in the film; sometimes referenced as a "black and white developer"). This is followed by fogging unexposed silver halide, usually either chemically or by exposure to light. Then the element is treated with a color developer (that is, a developer which will produce color in an imagewise manner upon reaction with other compounds in the film).

In a typical construction, a reversal film does not have any masking couplers. Furthermore, reversal films have a gamma generally between 1.5 and 2.0, and this is much higher than for typical negative materials.

The color reversal element of the present invention may particularly be a "daylight balanced" or "tungsten balanced" film. These terms simply mean that they have their color sensitivities and other parameters adjusted for exposure to a standard daylight or tungsten light, such as those described above. The daylight or tungsten balanced films of the present invention would typically be provided in association with an indication that they are daylight or tungsten balanced, respectively. The indication would most typically be found on the film, its container or packaging (including printed inserts provided with the film). The indication may, for example, be a printed statement that the film is daylight or tungsten balanced, or may be a code which when read would indicate to a user that the film is daylight or tungsten balanced (for example, a code which the user can reference in some other publication). For best results, the daylight or tungsten balanced films would be used on film writers that are set up to write onto daylight or tungsten balanced films, respectively. Such film writers would normally have an associated indication that they any particular set-up on them is for daylight or tungsten balanced films.

A daylight balanced color reversal element of the present invention may be constructed the same as the reversal element described. However, in the daylight balanced film the red, green and blue sensitive layers each preferably have a speed ≧135 (preferably ≧145) as measured at a density of 0.3. The foregoing speed for at least one of the layers, for example the blue sensitive layer (and optionally for the red and/or green sensitive layers), may be ≧150 or even ≧160. The Dmax of each of the red, green and blue sensitive layers of the daylight balanced film is preferably ≧3.30 (with a Dmax of ≧3.35 being preferred). However, the Dmax for at least one of the layers, for example the blue sensitive layer (and optionally for the red and/or green sensitive layers), may be ≧3.80 or even 4.0. ΔlogE measured from a density of 0.20 to 3.20 for each of the red, green and blue sensitive layers of the daylight balanced film, is preferably ≦1.85 (with the ΔlogE of ≦1.80 being preferred). However, the ΔlogE for at least one of the layers, for example the blue sensitive layer (and optionally for the red and/or green sensitive layers), may be ≦1.65.

A tungsten balanced color reversal element of the present invention may be constructed the same as the reversal element described. However, in the tungsten balanced film the red sensitive layer preferably has a speed ≧120 (although even ≧125 is possible) as measured at a density of 0.3. The green and blue sensitive layers preferably have a speed of ≧135 (preferably ≧145), as measured at a density of 0.3. The foregoing speed for at least one of the layers, for example the blue sensitive layer (and optionally for the red and/or green sensitive layers), may be ≧150 or even ≧155. The Dmax of each of the red, green and blue sensitive layers of the tungsten balanced film is preferably ≧3.30 (with a Dmax of ≧3.5 being preferred). However, the Dmax for at least one of the layers, for example the red sensitive layer (and optionally also for the blue and/or green sensitive layers), may be ≧3.6 or even 3.7. ΔlogE measured from a density of 0.20 to 3.20 for each of the red, green and blue sensitive layers of the daylight balanced film, is preferably ≦1.85 (with the ΔlogE of ≦1.80 being preferred. However, the ΔlogE for at least one of the layers, for example the green sensitive layer (and optionally also for the red and/or blue sensitive layers), may be ≦1.60.

Films having the above parameters can be constructed by using techniques known in the film building art. U.S. Pat. No. 4,792,518 and U.S. Pat. No. 4,656,122 describe methods used to vary the characteristic curve by controlling silver emulsions. Other methods can also be used. For example, high Dmax may be achieved by increased silver plus coupler in the high sensitivity layers, in the low sensitivy layers, or both. For example, high contrast as described by the ΔLogE parameter of this invention can be obtained by increasing a blend ratio of medium speed emulsion compared to low speed emulsion in the low sensitivity layer(s) of a film having multiple layers of the same spectral sensitivity. Alternatively, sensitometrically faster emulsions can be used in the low sensitivity layers. A low speed at a density of 0.3 (sometimes referenced herein as "toe speed" or "LT") can be increased by using photographically faster emulsions in the low sensitivity layers of a film having multiple layers of the same spectral sensitivity. A combination of these film construction techniques were used to construct films of the present invention.

Photographic elements according to the present invention will typically have at least one light sensitive silver halide emulsion layer and a support.

Photographic elements of the present invention can be single color elements but are preferably multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element of the present invention comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support). Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, with the reverse order on a reflective support being typical.

Photographic elements of the present invention can be used in conventional cameras including what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed. However, the color reversal elements of the present invention are preferably used by exposing in an electronic film writer as described above.

In the following discussion of suitable materials for use in elements of this invention, reference will be made to *Research Disclosure*, September 1994, Number 365, Item 36544, published by Kenneth Mason Publications, Ltd., Dudley Annex, 12a North Street, Emsworth, Hampshire P010 7DQ, ENGLAND, which will be identified hereafter by the term "Research Disclosure I." The Sections hereafter referred to are Sections of the Research Disclosure I.

The silver halide emulsions employed in the elements of this invention are negative-working, such as surface-sensitive emulsions or unfogged internal latent image forming emulsions. Suitable emulsions and their preparation as well as methods of chemical and spectral sensitization are described in Sections I through V. Color materials and development modifiers are described in Sections V through XX. Vehicles which can be used in the elements of the present invention are described in Section II, and various additives such as brighteners, antifoggants, stabilizers, light absorbing and scattering materials, hardeners, coating aids, plasticizers, lubricants and matting agents are described, for example, in Sections VI through X and XI through XIV. Manufacturing methods are described in all of the sections, other layers in Sections XI and XIV, processing methods and agents in Sections XIX and XX (although the present invention requires reversal processing of the element, as already defined above), and exposure alternatives in Section XVI (although again, exposure of the reversal film element of the present invention in a film writer, is preferred).

Supports for photographic elements of the present invention include polymeric films such as cellulose esters (for example, cellulose triacetate and diacetate) and polyesters of dibasic aromatic carboxylic acids with divalent alcohols (for example, poly(ethylene-terephthalate), poly(ethylenenapthalates)), paper and polymer coated paper. Such supports are described in further detail in *Research Disclosure I*, Section XV.

The photographic elements may also contain materials that accelerate or otherwise modify the processing steps of bleaching or fixing to improve the quality of the image. Bleach accelerators described in EP 193,389; EP 301,477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). DIR compounds are disclosed, for example, in "Developer-Inhibitor-Releasing (DIR) Couplers for Color Photography," C.R. Barr, J. R. Thirtle and P. W. Vittum in *Photographic Science and Engineering*, Vol. 13, p. 174 (1969), incorporated herein by reference. DIRs that have particular application in color reversal elements are disclosed in allowed U.S. patent applications Ser. Nos. 08/004,019 (Attorney Docket No. 65987), 8/005,319 (Attorney Docket No. 62077), 08/005,472 (Attorney Docket No. 63781, and 08/007,440 (Attorney Docket No. 67117.

It is also contemplated that the concepts of the present invention may be employed to obtain reflection color prints. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements of the present invention may be silver iodobromide, silver bromide, silver chloride, silver chlorobromide, silver chloroiodobromide, and the like. The type of silver halide grains preferably include polymorphic, cubic, and octahedral. The grain size of the silver halide may have any distribution known to be useful in photographic compositions, and may be ether polydipersed or monodispersed. Particularly useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micron) tabular grains. To achieve the lowest levels of granularity it is preferred to that aim tabular grain projected areas be satisfied with ultrathin ($t<0.06$ micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in *Research Disclosure*, June 1975, item 13452 and U.S. Pat. No. 3,772,031.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention can be imagewise exposed using any of the known techniques, including those described in *Research Disclosure I*, section XVI. This typically involves exposure to light in the visible region of the spectrum, and typically such exposure is of a live image through a lens. However, the photographic elements of the present invention are preferably exposed in a film writer as described above. Exposure in a film writer is an exposure to a stored image (such as a computer stored image) by means of light emitting devices (such as light controlled by light valves, CRT and the like).

Photographic elements comprising the composition of the invention can be processed in any color reversal process. Such processes, as described above, require first treating the element with a black and white developer, followed by fogging non-exposed grains using chemical or light fogging, followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water soluble salts and complexes of iron (III) (e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The present invention will be further described in the examples below.

EXAMPLE 1

A daylight balanced color reversal film of the present invention, film sample 101, was prepared according to the following description.

On a cellulose triacetate film support provided with a subbing layer was coated, each layer having the composition set forth below to prepare a multilayer color photographic light sensitive material, which was designated Sample 101. This example was designed for electronic film writers having a daylight balanced output exposure.

In the composition of the layers, the coating amounts are shown as g/m$^2$ except for sensitizing dyes, which are shown as the molar amount per mole of silver halide present in the same layer. "ECD" refers to equivalent circular diameter. Percentages of iodide ("%I") are mole percent of total halogen content.

| | |
|---|---|
| First Layer: Antihalation Layer | |
| Antihalation Coloidal Silver (as silver) | 0.43 |
| Gelatin | 2.45 |
| Second Layer: Intermediate Layer | |
| Gelatin | 1.22 |
| Third Layer: Slow Red Sensitive Layer | |
| Silver Iodobromide Emulsion - SC (as silver) (0.15 um ECD, 4.8% I) | 0.074 |
| Red Sensitizing Dye - 1 | 0.439 |
| Red Sensitizing Dye - 2 | 0.188 |
| Red Sensitizing Dye - 3 | 0.022 |
| Silver Iodobromide Emulsion - MC (as silver) (0.26 um ECD, 4.8% I) | 0.362 |
| Red Sensitizing Dye - 1 | 0.313 |
| Red Sensitizing Dye - 2 | 0.133 |
| Red Sensitizing Dye - 3 | 0.013 |
| Coupler C-1 | 0.446 |
| Solvent - 2 | 0.223 |
| Gelatin | 1.399 |
| Fourth Layer: Fast Red Sensitive Layer | |
| Silver Iodobromide Emulsion - FC (as silver) (0.56 um ECD, 3.4% I) | 0.809 |
| Red Sensitizing Dye - 1 | 0.432 |
| Red Sensitizing Dye - 2 | 0.101 |
| Red Sensitizing Dye - 3 | 0.022 |
| Coupler C-1 | 0.872 |

-continued

| | |
|---|---|
| Coupler Y-2 | 0.026 |
| Solvent - 2 | 0.439 |
| Gelatin | 1.798 |
| Fifth Layer: Intermediate Layer | |
| Competitor | 0.145 |
| Inhibitor for Color Correction | 0.001 |
| Gelatin | 0.61 |
| Sixth Layer: Slow Green Sensitive Layer | |
| Silver Iodobromide Emulsion - SM (as silver) (0.15 um ECD, 4.8% I) | 0.088 |
| Green Sensitizing Dye - 1 | 0.225 |
| Green Sensitizing Dye - 2 | 0.532 |
| Silver Iodobromide Emulsion - MM (as silver) (0.26 um ECD, 4.8% I) | 0.412 |
| Green Sensitizing Dye - 1 | 0.195 |
| Green Sensitizing Dye - 2 | 0.460 |
| Coupler M-1 | 0.539 |
| Solvent - 1 | 0.270 |
| Gelatin | 2.486 |
| Seventh Layer: Fast Green Sensitive Layer | |
| Silver Iodobromide Emulsion (as silver) (0.67 um ECD, 2.0% I) | 0.828 |
| Green Sensitizing Dye - 1 | 0.116 |
| Green Sensitizing Dye - 2 | 0.274 |
| Coupler M-1 | 0.804 |
| Coupler Y-2 | 0.039 |
| Solvent - 1 | 0.402 |
| Solvent - 2 | 0.004 |
| Gelatin | 1.819 |
| Eighth Layer: Intermediate Layer | |
| Absorber Dye | 0.108 |
| Gelatin | 0.61 |
| Ninth Layer: Yellow Filter Layer | |
| Carey Lea Silver | 0.048 |
| Gelatin | 0.61 |
| Tenth Layer: Slow Blue Sensitive Layer | |
| Silver Iodobromide Emulsion - SY (as silver) (0.37 um ECD, 3.4% I) | 0.156 |
| Blue Sensitizing Dye - 1 | 0.707 |
| Silver Iodobromide Emulsion - MY (as silver) (0.68 um ECD, 3.4% I) | 0.299 |
| Blue Sensitizing Dye - 1 | 0.707 |
| Coupler Y-1 | 0.639 |
| Solvent - 2 | 0.213 |
| Gelatin | 1.216 |
| Eleventh Layer: Fast Blue Sensitive Layer | |
| Silver Iodobromide Emulsion - FY (as silver) (1.35 um ECD, 2.0% I) | 1.066 |
| Blue Sensitizing Dye - 1 | 0.302 |
| Coupler Y-1 | 1.604 |
| Solvent - 2 | 0.535 |
| Gelatin | 2.809 |
| Twelfth Layer: First Protective Layer | |
| UV Protection Dye - 1 | 0.320 |
| UV Protection Dye - 2 | 0.056 |
| UV Protection Dye - 3 | 0.129 |
| Competitor | 0.065 |
| Gelatin | 1.40 |
| Thirteenth Layer: Second Protective Layer | |
| Bis(vinylsulfonymethane) | 0.29 |
| Fine Grain Silver Bromide (as silver) (0.07 um ECD, 0% I) | 0.12 |
| Carey Lea Silver (as silver) | 0.0027 |

-continued

| | |
|---|---|
| Matte (3.3 um spherical diameter) | 0.02 |
| Gelatin | 0.98 |

EXAMPLE 2

A tungsten balanced color reversal film of the present invention, film sample 102, was prepared according to the following description.

On a cellulose triacetate film support provided with a subbing layer was coated, each layer having the composition set forth below to prepare a multilayer color photographic light sensitive material, which was designated Sample 102. This example was designed for electronic film writers having a Tungsten balanced output exposure.

In the composition of the layers, the coating amounts are shown as g/m$^2$ except for sensitizing dyes, which are shown as the molar amount per mole of silver halide present in the same layer. "ECD" refers to equivalent circular diameter. Percentages of iodide ("%I") are mole percent of total halogen content.

| | |
|---|---|
| First Layer: Antihalation Layer | |
| Antihalation Coloidal Silver (as silver) | 0.43 |
| Gelatin | 2.45 |
| Second Layer: Intermediate Layer | |
| Gelatin | 1.22 |
| Third Layer: Slow Red Sensitive Layer | |
| Silver Iodobromide Emulsion - SC (as silver) (0.15 um ECD, 4.8% I) | 0.159 |
| Red Sensitizing Dye - 1 | 0.736 |
| Red Sensitizing Dye - 3 | 0.059 |
| Silver Iodobromide Emulsion - MC (as silver) (0.29 um ECD, 4.8% I) | 0.284 |
| Red Sensitizing Dye - 1 | 0.613 |
| Red Sensitizing Dye - 3 | 0.049 |
| Coupler C-1 | 0.451 |
| Solvent - 2 | 0.225 |
| Gelatin | 1.787 |
| Fourth Layer: Fast Red Sensitive Layer | |
| Silver Iodobromide Emulsion - FC (as silver) (0.58 um ECD, 3.4% I) | 0.453 |
| Red Sensitizing Dye - 1 | 0.092 |
| Red Sensitizing Dye - 3 | 0.007 |
| Silver Iodobromide Emulsion - FC (as silver) (0.66 um ECD, 3.4% I) | 0.453 |
| Red Sensitizing Dye - 1 | 0.368 |
| Red Sensitizing Dye - 3 | 0.030 |
| Coupler C-1 | 0.970 |
| Solvent - 2 | 0.485 |
| Gelatin | 1.625 |
| Fifth Layer: Intermediate Layer | |
| Competitor | 0.145 |
| Gelatin | 0.61 |
| Sixth Layer: Slow Green Sensitive Layer | |
| Silver Iodobromide Emulsion - SM (as silver) (0.15 um ECD, 4.8% I) | 0.152 |
| Green Sensitizing Dye - 2 | 0.935 |
| Green Sensitizing Dye - 3 | 0.272 |
| Silver Iodobromide Emulsion - MM (as silver) | 0.296 |

-continued

| | |
|---|---|
| (0.34 um ECD, 4.8% I) | |
| Green Sensitizing Dye - 2 | 0.807 |
| Green Sensitizing Dye - 3 | 0.298 |
| Coupler M-1 | 0.488 |
| Solvent - 1 | 0.244 |
| Gelatin | 2.077 |
| Seventh Layer: Fast Green Sensitive Layer | |
| Silver Iodobromide Emulsion (as silver) | 0.775 |
| (0.69 um ECD, 2.0% I) | |
| Green Sensitizing Dye - 2 | 0.355 |
| Green Sensitizing Dye - 3 | 0.177 |
| Coupler M-1 | 0.760 |
| Solvent - 1 | 0.380 |
| Gelatin | 2.244 |
| Eighth Layer: Intermediate Layer | |
| Gelatin | 0.61 |
| Ninth Layer: Yellow Filter Layer | |
| Carey Lea Silver | 0.101 |
| Gelatin | 0.61 |
| Tenth Layer: Slow Blue Sensitive Layer | |
| Silver Iodobromide Emulsion - MY (as silver) | 0.610 |
| (0.79 um ECD, 3.4% I) | |
| Blue Sensitizing Dye - 1 | 0.694 |
| Coupler Y-2 | 1.058 |
| Coupler C-1 | 0.030 |
| Solvent - 2 | 0.121 |
| Gelatin | 1.229 |
| Eleventh Layer: Fast Blue Sensitive Layer | |
| Silver Iodobromide Emulsion - FY (as silver) | 0.124 |
| (0.15 um ECD, 4.8% I) | |
| Blue Sensitizing Dye - 1 | 0.695 |
| Silver Iodobromide Emulsion - FY (as silver) | 1.117 |
| (1.41 um ECD, 2.0% I) | |
| Blue Sensitizing Dye - 1 | 0.302 |
| Coupler Y-2 | 2.047 |
| Coupler C-1 | 0.044 |
| Solvent - 2 | 0.227 |
| Gelatin | 4.338 |
| Twelfth Layer: First Protective Layer | |
| UV Protection Dye - 1 | 0.320 |
| UV Protection Dye - 2 | 0.056 |
| Competitor | 0.057 |
| Gelatin | 0.861 |
| Thirteenth Layer: Second Protective Layer | |
| Bis(vinylsulfonymethane) | 0.25 |
| Fine Grain Silver Bromide (as silver) | 0.12 |
| (0.07 um ECD, 0% I) | |
| Carey Lea Silver (as silver) | 0.0027 |
| Matte (3.3 um spherical diameter) | 0.06 |
| Gelatin | 0.98 |

The components employed for the preparation of the light-sensitive materials not already identified above are shown below:

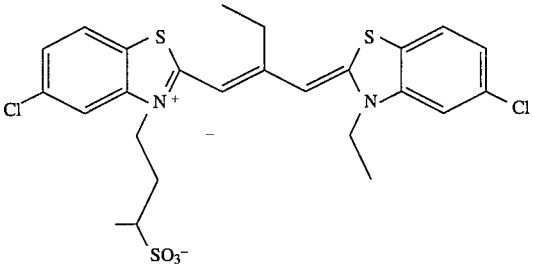

Red Sensitizing Dye-1

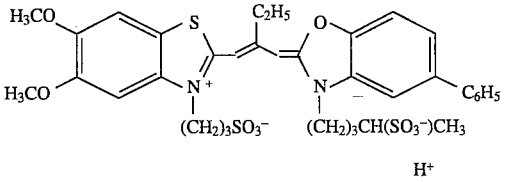

Red Sensitizing Dye-2

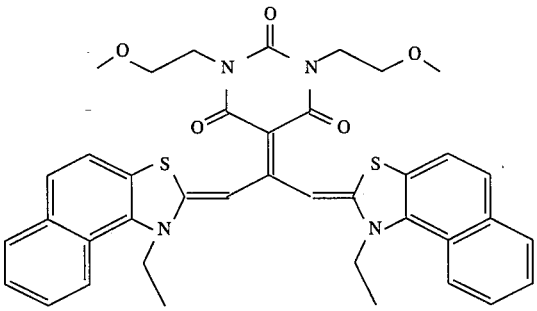

Red Sensitizing Dye-3

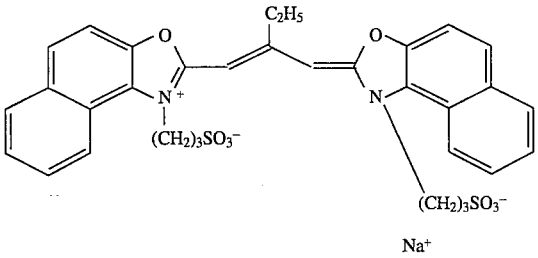

Green Sensitizing Dye-1

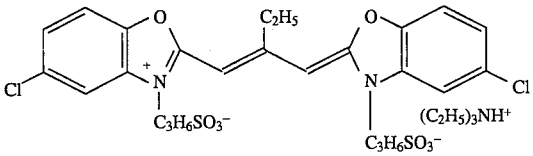

Green Sensitizing Dye-2

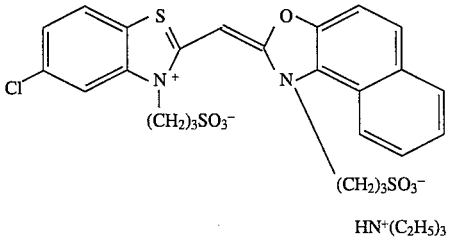

Blue Sensitizing Dye-1

-continued

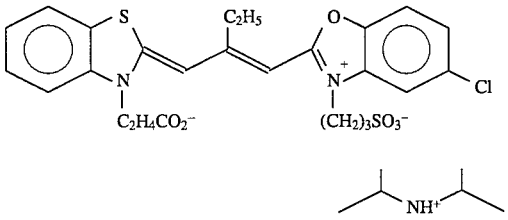

Green Sensitizing Dye-3

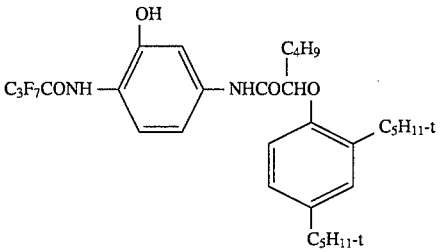

Coupler C-1

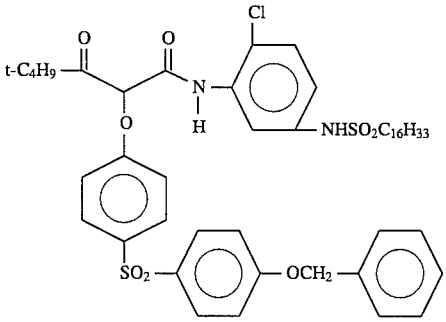

Coupler Y-2

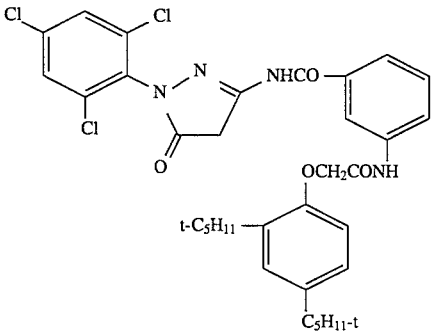

Coupler M-1

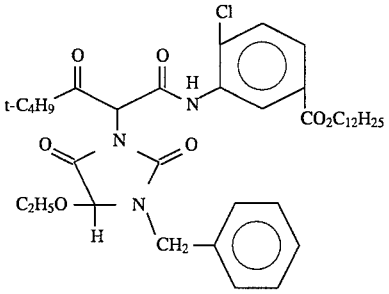

Coupler Y-1

Solvent 1: tritolyl phosphates

Solvent 2: dibutyl phthalate

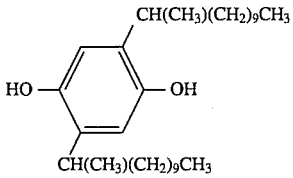

Competitor

Absorber Dye: Tartrazine Yellow

Inhibitor for Color Correction: (4-carboxymethyl-4-thiazoline-thione)

UV Protection Dye-1: (Phenol,2-(2H-benzotriazol-2-yl-)-4,6-bix(1,1-dimethylpropyl)-)

UV Protection Dye-2: (2-[(2-Hydroxy-3-3-(1,1-dimethylethyl)-5-methyl)phenyl]-5-chloro Benzotriazole)

UV Protection Dye-3: Propanedinitrile,(3-(dihexylamino)-2-propenylidene)-

EXAMPLE 3

Photographic Properties

Film sample 101, and three commercially available daylight balanced films identified as Films A, B, C and E were exposed through a step tablet to a simulated daylight light source for 1/100th second and then processed in Kodak Ektachrome (TM) E6 process described in the British Journal of Photography Annual 1988, 191 and particularly pages 194–196. The simulated daylight light source was a standard daylight balance light source described in ANSI PH2.29-1967 (R1976).

Film sample 102 and a commercially available tungsten balanced film identified as Film D, were exposed through a step tablet to a simulated Tungsten light source for 5 seconds and then processed in Kodak Ektachrome (TM) E6 process described in the British Journal of Photography Annual 1988, 191 and particularly pages 194–196. The simulated Tungsten light source was a standard tungsten balanced light source described in ANSI PH2.35-1969 (R1976).

Table 1 shows sensitometric characteristics obtained from invention samples 101 and 102 compared to the commercially available films A, B, C, D and E. Most of the commercially available films are commonly used as output films for electronic film writers. Table 1 shows the combination of film sensitometric characteristics that make the Invention Examples 101 and 102 superior to the comparative films commonly used today, by matching the sensitometric response of the invention examples to the particular needs of the electronic films writers. In Table 1 "C", "M" and "Y" indicate the red, green and blue sensitive layers, respectively, ΔLogE is the difference in logE values measured at a density between 0.2 and 3.2 as discussed above, and "LT" is the speed as measured at a density of 0.3 as discussed above.

TABLE 1

| | | Film E | Invention Sample 101 | Film A | Film B | Film C | Invention Sample 102 | Film D |
|---|---|---|---|---|---|---|---|---|
| $D_{max}$ | R | 3.12 | 3.36 | 3.14 | 3.32 | 3.64 | 3.67 | 3.03 |
| | G | 3.29 | 3.82 | 3.40 | 3.50 | 3.94 | 3.72 | 3.10 |
| | B | 3.41 | 4.06 | 3.66 | 3.89 | 4.07 | 3.57 | 3.33 |
| ΔlogE | R | N/A* | 1.80 | N/A[1] | 2.10 | 1.75 | 1.80 | N/A[2] |
| (.2–3.2) | G | 2.0 | 1.60 | 2.05 | 2.00 | 1.90 | 1.60 | N/A[3] |
| | B | 2.0 | 1.65 | 1.95 | 1.85 | 1.85 | 1.80 | 2.0 |
| LT | R | 140 | 151 | 131 | 181 | 127 | 123 | 113 |
| (0.30) | G | 144 | 151 | 129 | 182 | 116 | 146 | 118 |
| | B | 146 | 162 | 142 | 190 | 126 | 151 | 129 |

N/A*—doesn't reach 3.2 (>2.5 based on highest density reached)
N/A[1]—doesn't reach 3.2 (>2.5 based on highest density reached)
N/A[2]—doesn't reach 3.2 (>2.15 based on highest density reached))
N/A[3]—doesn't reach 3.2 (>2.4 based on highest density reached))

EXAMPLE 4

Photographic Properties—Reproduction of Image Densities in an Original

Invention film sample 101 and commercially available Film E were exposed on a commercially available FIRE 1000 film writer. The exposure intensity was set for mid-range and remained the same for both films. The device was set for a daylight balanced film and was not re-calibrated for either film. The maximum and minimum densities that could be obtained on the film following standard E-6 processing, from the FIRE 1000 film writer, for each color record, are provided in Tables 2 and 3. It will be seen that the maximum and minimum densities for each record of the invention film, was higher and lower, respectively, than what could be obtained with the commercially available Film E, without any necessity of increasing exposure intensity or exposure time (such as by repeated exposure) from the writer.

TABLE 2

FILM OUTPUT BY Film Writer on Sample 101 (Invention)

| | Measured Maximum Density | Measured Minimum Density |
|---|---|---|
| Red | 3.450 | 0.220 |
| Green | 3.660 | 0.200 |
| Blue | 3.840 | 0.170 |

TABLE 3

Film Output by Film Writer on Film E (Comparative)

| | Measured Maximum Density | Measured Minimum Density |
|---|---|---|
| Red | 2.980 | 0.240 |
| Green | 3.260 | 0.220 |
| Blue | 3.260 | 0.200 |

As seen from Tables 2 and 3, the film of the present invention, for each color record, was able to provide higher measured maximum densities and lower measured minimum densities. This means that the inventive film when used to record the output of an electronic film writer, is capable of more faithfully reproducing a wider range of densities which an original film might have, than was the comparative film.

EXAMPLE 5

Photographic Properties—Reproduction of Image Colors in an Original

A specimen of an original film was exposed with a step tablet and processed so as to provide an image with a range of densities for each of red, green and blue light, corresponding to steps 1 (maximum achievable density on the film) through 21 (minimum achievable density on the film). The density of red, green and blue light on the original film were measured at each step. The film was then digitally scanned and the image stored. The stored image was then output on a FIRE 1000 film writer to a sample of inventive film 101 (referenced as "EOF" in FIG. 1) and comparative film E (referenced as "E100" in FIG. 1). The device was set for a daylight balanced film and optimally calibrated for each film individually. Following exposure both the inventive and comparative film were processed with standard E-6 processing. The density of red light on the output film was measured at each step, and then compared with the red light density of the original film at each step. If there was no difference, the value was plotted as "0" on the Figure for "Differences in Red Light" The value of any difference at each step was also recorded and is shown in FIG. 1. The same process was repeated for green and blue light, and the results plotted in the Figure.

As will be seen from FIG. 1, the inventive film faithfully reproduced reds and greens of the original over the entire range of densities. The inventive film had some deviation in blue densities at higher image densities (low step numbers). On the other hand, the comparative film exhibited far greater deviations in blue densities at higher image densities, as well as exhibiting significant deviations in red and green light densities. Furthermore, the comparative film exhibited noticeable green, and significant blue, density deviations even at low image densities (high step numbers).

Thus, as illustrated by the Figure, the inventive film can more faithfully reproduce colors appearing in the original than can the comparative film (in both hue as well as luminance).

It should be noted that, if desired, the present film could be used in an existing film writer by decreasing exposure time while still obtaining the density ranges obtainable with existing films. This would allow an increase in total throughput.

The preceding examples are set forth to illustrate specific embodiments of this invention and are not intended to limit the scope of the compositions or materials of the invention. It will be understood that variations and modifications can be effected within the spirit and scope of the invention.

We claim:

1. A color reversal film having a red sensitive silver halide emulsion layer containing a cyan dye forming coupler, a green sensitive silver halide emulsion layer containing a magenta dye forming coupler, and a blue sensitive silver halide emulsion layer containing a yellow dye forming coupler, the red, green and blue sensitive silver halide emulsion layers each having a characteristic curve with a speed ≧120 as measured at a density of 0.3, a Dmax of ≧3.30, and a ΔlogE ≦1.85 measured from a density of 0.20 to 3.20, the speed, Dmax, and ΔlogE being measured following exposure and processing of the film in the standard Process E-6.

2. A color reversal film according to claim 1 wherein the Δlog E of the characteristic curve of the red, green and blue sensitive layers is ≦1.80.

3. A daylight balanced color reversal film having a red sensitive silver halide emulsion layer containing a cyan dye forming coupler, a green sensitive silver halide emulsion layer containing a magenta dye forming coupler, and a blue sensitive silver halide emulsion layer containing a yellow dye forming coupler, the red, green and blue sensitive silver halide emulsion layers each having a characteristic curve with a speed ≧135 as measured at a density of 0.3, a Dmax of ≧3.30 and a ΔlogE ≦1.85 measured from a density of 0.20 to 3.20, the speed, Dmax and ΔlogE being measured following exposure and processing of the film in the standard Process E-6.

4. A daylight balanced color reversal film according to claim 3 wherein the green and blue sensitive layers each has a characteristic curve with a Dmax of ≧3.50.

5. A daylight balanced color reversal film according to claim 3 wherein the red, green and blue sensitive layers each has a characteristic curve with a speed of ≧145 as measured at a density of 0.3.

6. A daylight balanced color reversal film according to claim 3 wherein the red, green and blue sensitive layers each has a characteristic curve with a ΔlogE of ≦1.80 measured from a density of 0.20 to 3.20.

7. A tungsten balanced color reversal film having a red sensitive silver halide emulsion layer containing a cyan dye forming coupler, a green sensitive silver halide emulsion layer containing a magenta dye forming coupler, and a blue sensitive silver halide emulsion layer containing a yellow dye forming coupler, the red sensitive silver halide emulsion layer having a characteristic curve with a speed ≧120 as measured at a density of 0.3, the green and blue sensitive silver halide emulsion layers both having a characteristic curve with a speed ≧135 as measured at a density of 0.3, and each of the red, green and blue sensitive silver halide emulsion layers having a characteristic curve with a Dmax ≧3.30 and a ΔlogE ≦1.85 measured from a density of 0.20 to 3.20, the speed, Dmax and ΔlogE being measured following exposure and processing of the film in the standard Process E-6.

8. A tungsten balanced color reversal film according to claim 7 wherein the red, green and blue sensitive layers each has a characteristic curve with a Dmax of ≧3.50.

9. A tungsten balanced color reversal film according to claim 7 wherein the red sensitive layer has a characteristic curve with a speed of ≧140 as measured at a density of 0.3.

10. A tungsten balanced color reversal film according to claim 7 wherein the green and blue sensitive layers each has a characteristic curve with a speed of ≧145 as measured at a density of 0.3.

11. A tungsten balanced color reversal film according to claim 7 wherein the red, green and blue sensitive layers each has a characteristic curve with a ΔlogE of ≦1.80 measured from a density of 0.20 to 3.20.

12. A method of processing an exposed color reversal film of claim 1, the method comprising first treating the film with a black and white developer to develop exposed silver grains, then fogging non-exposed silver halide grains, then treating the film with a color developer.

13. A method of processing an exposed color reversal film of claim 3, the method comprising first treating the film with a black and white developer to develop exposed silver grains, then fogging non-exposed silver halide grains, then treating the film with a color developer.

14. A method of processing an exposed color reversal film of claim 7, the method comprising first treating the film with a black and white developer to develop exposed silver grains, then fogging non-exposed silver halide grains, then treating the film with a color developer.

15. A method of processing an exposed daylight balanced color reversal film having:

a red sensitive silver halide emulsion layer containing a cyan dye forming coupler, a green sensitive silver halide emulsion layer containing a magenta dye forming coupler, and a blue sensitive silver halide emulsion layer containing a yellow dye forming coupler, the red, green and blue sensitive silver halide emulsion layers each having a characteristic curve with a speed ≧135 as measured at a density of 0.3, a Dmax of ≧3.30 and a ΔlogE ≦1.85 measured from a density of 0.20 to 3.20, the speed Dmax and ΔlogE being measured following exposure and processing of the film in the standard Process E-6;

the method comprising first treating the film with a black and white developer to develop exposed silver grains, then fogging non-exposed silver halide grains, then treating the film with a color developer.

16. A method of processing an exposed tungsten balanced color reversal film having:

a red sensitive silver halide emulsion layer containing a cyan dye forming coupler, a green sensitive silver halide emulsion layer containing a magenta dye forming coupler, and a blue sensitive silver halide emulsion layer containing a yellow dye forming coupler, the red sensitive silver halide emulsion layer having characteristic curve with a speed ≧120 as measured at a density of 0.3, the green and blue sensitive silver halide emulsion layers both having a characteristic curve with a speed ≧135 as measured at a density of 0.3, and each of the red, green and blue sensitive silver halide emulsion layers having a characteristic curve with a Dmax ≧3.30 and a ΔlogE ≦1.85 measured from a density of 0.20 to 3.20, the speed Dmax and ΔlogE being measured following exposure and processing of the film in the standard process E-6;

the method comprising first treating the film with a black and white developer to develop exposed silver grains, then fogging non-exposed silver halide grains, then treating the film with a color developer.

17. A method of exposing and processing a daylight balanced color reversal film, the film having:

a red sensitive silver halide emulsion layer containing a cyan dye forming coupler, a green sensitive silver halide emulsion layer containing a magenta dye forming coupler, and a blue sensitive silver halide emulsion layer containing a yellow dye forming coupler, the red, green and blue sensitive silver halide emulsion layers each having a characteristic curve with a speed ≧135 as measured at a density of 0.3, a Dmax of ≧3.30 and a ΔlogE ≦1.85 measured from a density of 0.20 to 3.20, the speed, Dmax and ΔlogE being measured following exposure and processing of the film in the standard Process E-6;

the method comprising exposing the film to an output of a film writer the output of which is daylight balanced;

then processing the film to produce a positive image by first treating the film with a black and white developer to develop exposed silver grains, then fogging non-exposed silver halide grains, then treating the film with a color developer.

18. A method of exposing and processing a tungsten balanced color reversal film, the film having:

a red sensitive silver halide emulsion layer containing a cyan dye forming coupler, a green sensitive silver halide emulsion layer containing a magenta dye forming coupler, and a blue sensitive silver halide emulsion layer containing a yellow dye forming coupler, the red sensitive layer having a speed ≧120 as measured at a density of 0.3, the green and blue sensitive silver halide emulsion layers both having a characteristic curve with a speed ≧135 as measured at a density of 0.3, and each of the red, green and blue sensitive silver halide emulsion layers having a characteristic curve with a Dmax ≧3.30 and a ΔlogE ≦1.85 measured from a density of 0.20 to 3.20, the speed, Dmax and ΔlogE being measured following exposure and processing of the film in the standard Process E-6;

the method comprising exposing the film to an output of a film writer the output of which is tungsten balanced;

then processing the film to produce a positive image by first treating the film with a black and white developer to develop exposed silver grains, then fogging non-exposed silver halide grains, then treating the film with a color developer.

* * * * *